US006502586B2

(12) United States Patent
Tsai

(10) Patent No.: US 6,502,586 B2
(45) Date of Patent: Jan. 7, 2003

(54) HAIR CLASP

(76) Inventor: Kai-Mou Tsai, 4/F., No. 1, Lane 135, Tao-Hsiang Rd., Peitou Dist., Taipei City (TW)

( * ) Notice: Subject to any disclaimer, the term of this patent is extended or adjusted under 35 U.S.C. 154(b) by 0 days.

(21) Appl. No.: 09/854,532

(22) Filed: May 15, 2001

(65) Prior Publication Data

US 2002/0170568 A1 Nov. 21, 2002

(51) Int. Cl.[7] ..... A45D 8/12; A42B 3/00
(52) U.S. Cl. ..... 132/275; 2/411; 2/413
(58) Field of Search ..... 132/275; 2/411, 2/413, 171, 209.13, 410, 412, 417, 418, 420

(56) References Cited

U.S. PATENT DOCUMENTS 2,593,188 A * 4/1952 Rikelman ..... 2/209.13
4,727,599 A * 2/1988 Rappaport et al. ..... 455/351
5,027,992 A * 7/1991 Murray ..... 224/181
5,031,246 A * 7/1991 Kronenberger ..... 2/197
5,129,106 A * 7/1992 Liou ..... 2/411
5,243,707 A * 9/1993 Bodinet ..... 2/200.1
5,272,856 A * 12/1993 Pharo ..... 53/472
5,427,123 A * 6/1995 Odenthal ..... 132/275
6,049,912 A * 4/2000 Linehan ..... 2/209.13

* cited by examiner

*Primary Examiner*—John J. Wilson
*Assistant Examiner*—Robyn Kieu Doan
(74) *Attorney, Agent, or Firm*—Rosenberg, Klein & Lee

(57) ABSTRACT

A hair clasp includes an inflatable body of a particular design, the inflatable body having a smoothly arched receiving portion in a bottom side thereof, a resilient clasp element installed in the smoothly arched receiving portion of the inflatable body and adapted to secure the inflatable body to the head of a person, and a flat air valve installed in the inflatable body for enabling air to be driven into the inflatable body to inflate the inflatable body.

1 Claim, 3 Drawing Sheets

HAIR CLASP

BACKGROUND OF THE INVENTION

The present invent relates to a hair clasp and, more specifically, to such a hair clasp, which comprises an inflatable body that shows a particular design when inflated.

Conventional hair clasps are commonly injection-molded from plastics of different colors or having different designs. Some hair clasps may be provided with fabric ornaments to attract consumers. However, these conventional hair clasp designs are monotonous and less attractive.

SUMMARY OF THE INVENTION

It is one object of the present invention to provide a hair clasp which is inflatable. It is another object of the present invention to provide an inflatable hair clasp, which shows an attractive design when inflated. According to one aspect of the present invention, the hair clasp includes an inflatable body of a particular design, the inflatable body having a smoothly arched receiving portion in a bottom side thereof, a resilient clasp element installed in the smoothly arched receiving portion of the inflatable body and adapted to secure the inflatable body to the head of a person, and a flat air valve installed in the inflatable body for enabling air to be driven into the inflatable body to inflate the inflatable body. According to another aspect of the present invention, the flat air valve comprises two valve flaps sealed together, an air passage defined inbetween the valve flaps through which air is driven into the inside of the inflatable body to inflate the inflatable body, and an adhesive element covered on an inner surface of each of the valve flaps for enabling the valve flaps to be adhered to each other to close the air passage.

DETAILED DESCRIPTION OF THE PREFERRED EMBODIMENT

Figure 3:
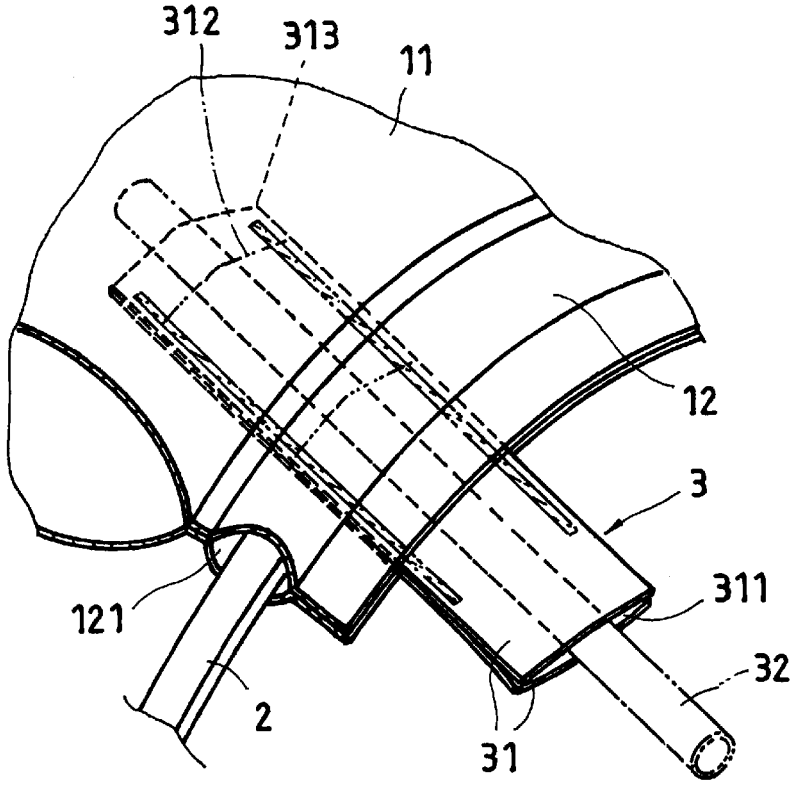
FIG. 3 is an enlarged view of a part of the present invention, showing a tube inserted into the air passage of the flat air valve.
Figure 1:
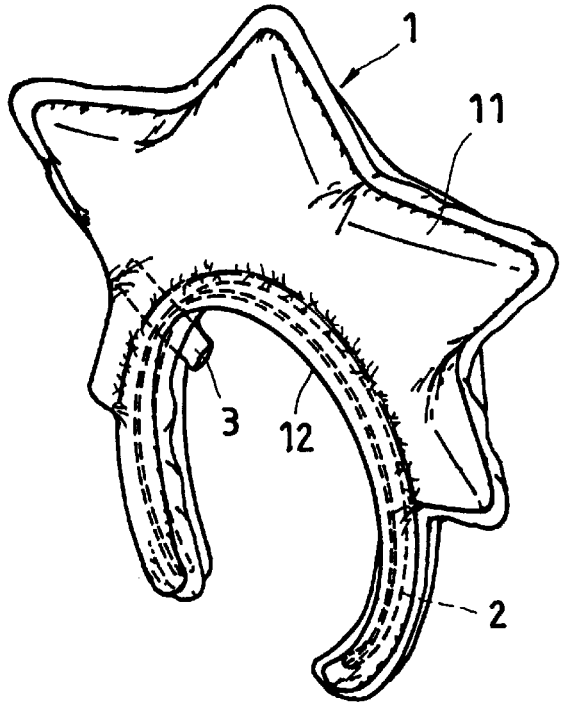
FIG. 1 is a perspective view of a hair clasp according to the present invention.
Figure 2:
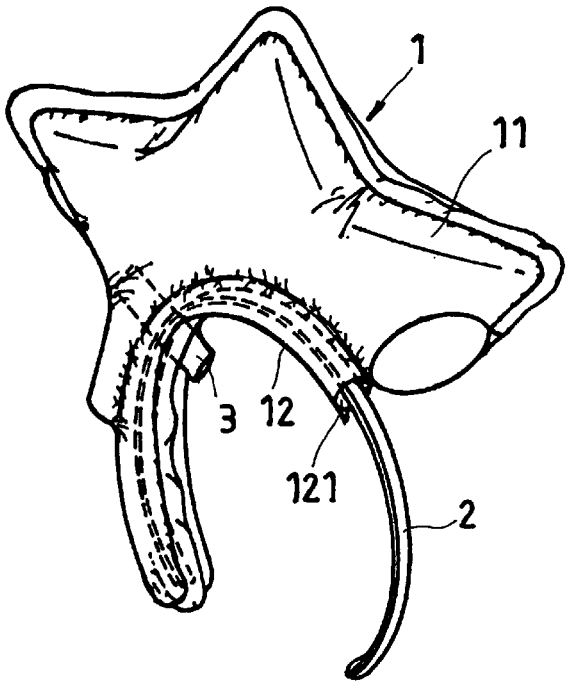
FIG. 2 is a cutaway view of the hair clasp according to the present invention.

Referring to FIGS. from 1 through 4, a hair clasp 1 is shown comprising an inflatable body 11 and a resilient clasp element 2 installed in the inflatable body 11. When inflated, the inflatable body 11 shows a particular design, for example, the shape of a star. The inflatable body 11 comprises a smoothly arched receiving portion 121 in the bottom side 12. The resilient clasp element 2 is mounted in the smoothly arched receiving portion 121 of the inflatable body 11, and adapted to secure the inflatable body 11 to the user's head 4. The inflatable body 11 comprises a flat air valve 3. The air valve 3 is comprised of two valve flaps 31 sealed together, defining an air passage 311. The valve flaps 31 each have an inner surface coated with a layer of an adhesive element 312. The air valve 3 has an inner protruding end 313 suspending inside the inflatable body 11. Due to the effect of the layer of adhesive element 312, the valve flaps 31 are adhered to each other to close the air passage 311. When in use, a tube 32 is inserted inbetween the valve flaps 31 to open the air passage 311, and air is blown into the inside of the inflatable body 11 to inflate the inflatable body 11. After inflation, the tube 32 is removed from the inflatable body 11, and the inside air pressure automatically compresses the inner protruding end 313 to close the air passage 311.

Figure 4:
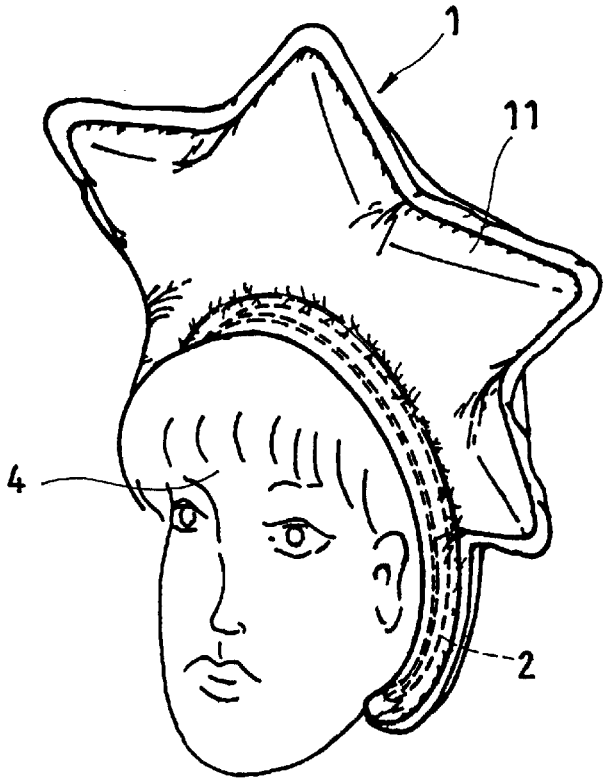
FIG. 4 shows the inflatable body of the hair clasp inflated, the hair clasp secured to the head of a person according to the present invention.
Figure 5:
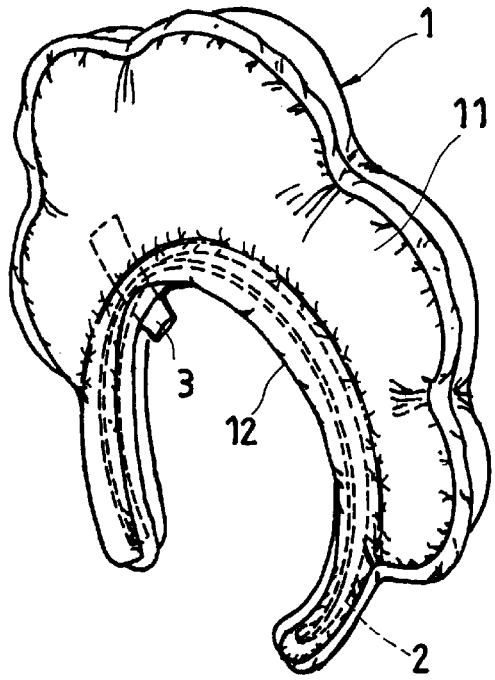
FIG. 5 shows another design of the inflatable body according to the present invention.
Figure 6:
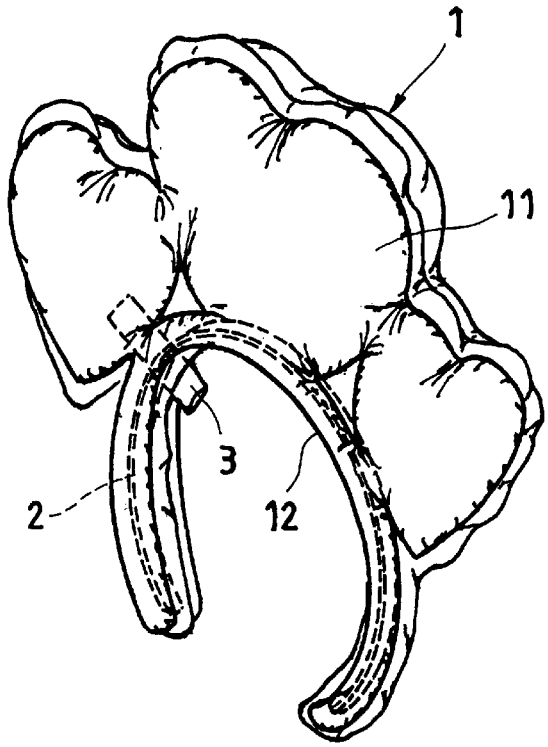
FIG. 6 shows still another design of the inflatable body according to the present invention.

The inflatable body 11 of the hair clasp 1 can be made having any of a variety of designs. FIGS. 4 and 5 show two different designs of the inflatable body 11.

A prototype of hair clasp has been constructed with the features of FIGS. 1~6. The hair clasp functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A hair clasp comprising:

an inflatable body having a receiving portion formed on a bottom surface thereof;

a resilient clasp element received within said receiving portion of said inflatable body and being adapted to secure said inflatable body to a user's head; and, a flat air valve mounted on said inflatable body for enabling air to be driven into said inflatable body to inflate said inflatable body, said flat air valve having a pair of valve flaps sealed each to the other, an air passage being defined between said pair of valve flaps through which air is driven into an interior of said inflatable body to inflate said inflatable body, an adhesive layer being formed on an inner surface of each of said valve flaps for enabling said valve flaps to be releasably adhered to each other to selectively close said air passage.

* * * * *